US005778612A

United States Patent [19]

Kissinger et al.

[11] Patent Number: 5,778,612

[45] Date of Patent: Jul. 14, 1998

[54] PARTITION PANEL CONTAINING DATA PROCESSING OR COMMUNICATIONS EQUIPMENT

[76] Inventors: Terrance G. Kissinger, 2136 Pullman Ave., Belmont, Calif. 94002; Steven M. Kissinger, 1277 Poplar Ave. #107, Sunnyvale, Calif. 94086

[21] Appl. No.: 554,235

[22] Filed: Nov. 8, 1995

Related U.S. Application Data

[63] Continuation of Ser. No. 396,365, Feb. 27, 1995, abandoned, which is a continuation of Ser. No. 272,885, Jul. 7, 1994, abandoned, which is a continuation of Ser. No. 136,487, Oct. 13, 1993, abandoned, which is a continuation of Ser. No. 866,726, Apr. 10, 1992, abandoned, which is a continuation-in-part of Ser. No. 757,884, Sep. 11, 1991, Pat. No. 5,125,202, which is a continuation-in-part of Ser. No. 619,368, Nov. 28, 1990, abandoned.

[51] Int. Cl.[6] ..... E04B 2/00

[52] U.S. Cl. ..... 52/205; 52/239; 52/67; 52/220.1; 52/220.7; 174/48; 160/37

[58] Field of Search ..... 160/202, 135, 160/37; 52/64, 67, 239, 205, 220.7, 220.1; 174/48

[56] References Cited

U.S. PATENT DOCUMENTS

| | | | |
|---|---|---|---|
| 4,870,908 | 10/1989 | Wolters et al. | 160/37 |
| 4,911,087 | 3/1990 | Couvrette | 52/67 |
| 4,932,177 | 6/1990 | Hinden | 52/221 |
| 5,068,287 | 11/1991 | Lewis | 52/64 |
| 5,125,202 | 6/1992 | Kisinger | 52/239 |
| 5,129,200 | 7/1992 | Kaneko | 52/205 |
| 5,219,406 | 6/1993 | Raz | 52/239 X |
| 5,277,006 | 1/1994 | Ruster | 52/239 |
| 5,309,686 | 5/1994 | Underwood et al. | 52/64 |
| 5,321,579 | 6/1994 | Brown et al. | 52/239 |

*Primary Examiner*—Wynn E. Wood

*Attorney, Agent, or Firm*—Skjerven, Morrill, MacPherson, Franklin & Friel LLP; David E. Steuber

[57] ABSTRACT

A partition panel of the kind commonly used in "open office" systems defines an internal cavity which is used to house pieces of data processing or communications equipment such as a computer, a telephone, a modem and a facsimile machine. This equipment is manufactured using current miniaturization techniques to fit inside the internal cavity of the partition panel. As a result, significant space savings are realized, pilferage of the equipment is made much more difficult, and numerous other advantages are realized.

20 Claims, 5 Drawing Sheets

PARTITION PANEL CONTAINING DATA PROCESSING OR COMMUNICATIONS EQUIPMENT

RELATED APPLICATIONS

This application is a continuation of application Ser. No. 08/396,365, filed Feb. 27, 1995, now abandoned, which was a continuation of application Ser. No. 08/272,885, filed Jul. 7, 1994, abandoned, which was a continuation of application Ser. No. 08/136,487, filed Oct. 13, 1993, abandoned, which was a continuation of application Ser. No. 07/866,726, filed Apr. 10, 1992, abandoned, which was a continuation-in-part of application Ser. No. 07/757,884, filed Sep. 11, 1991, now U.S. Pat. No. 5,125,202, which was a continuation-in-part of application Ser. No. 07/619,368, filed Nov. 28, 1990, abandoned.

FIELD OF THE INVENTION

This invention relates to the partitions that are widely used in offices, factories and homes to form workstations or "open plan" offices and, in particular, to an arrangement for using such partitions to house data processing or communications equipment such as computers, telephones, facsimile machines and the like.

BACKGROUND OF THE INVENTION

With the increasing use of nodular workstations and the accompanying data processing and communications equipment that are used by workers in performing their jobs, ways are always being sought to minimize the space occupied by this equipment while increasing worker productivity. Moreover, businesses are concerned with reducing the amount of equipment lost by pilferage, increasing safety in the work environment, and finding economic ways to allow workers to share capital equipment without impairing their job performance.

SUMMARY OF THE INVENTION

This invention addresses all of these concerns. It flows from the recognition that the dimensions of data processing and communications equipment are continually being reduced, by means of integrated circuit and other technologies, and that the partition panels used in open office systems are themselves a valuable space resource which until now has been ignored.

Partition panels typically have an outside thickness of approximately two inches. Allowing room for the outside covering (typically a fabric, laminate or glass) and structural elements, there are normally at least one and a half inches available on the inside for housing, for example, a computer, a word processor and an other item of equipment. For example, assuming a panel five feet high and four feet wide, there exists a volume of approximately two and a half cubic feet available within the panel. With today's miniaturization, this is easily large enough to hold all of the equipment which an office worker normally requires.

Accordingly, in accordance with this invention, a partition panel is used as a casing to enclose any type of equipment used for communications or data processing, the equipment being positioned at selected locations within a partition panel.

In a preferred embodiment, a plurality of computers are positioned inside a multiple computer panel. Various computer "cards", as appropriate, are connected to each of the computers. Also positioned inside the panel are hard disk drives associated with each of the computers, a power supply unit, and a means for cooling the components. To provide easy access, the foregoing components are preferably mounted within a movable panel such as is described in U.S. Pat. No. 5,125,202, filed Sep. 11, 1991, which is incorporated herein in its entirety.

The multiple computer panel may serve a number of individual workstations. Each workstation has an "interactive panel" containing the devices which the worker needs in order to perform his or her job—for example, a telephone, a computer display, a speaker, a floppy disk drive, and keyboard and mouse ports. Power and data lines extend between the multiple computer panel and each interactive panel, typically through base units positioned at the bottoms of the panels. Power and data lines may be connected to the multiple computer panel through a power pole extending from the ceiling to the floor and running alongside the panel.

In alternative embodiments, optical fibers and infrared or microwave communication channels may be used to provide for an exchange of data between the multiple computer panel and each interactive panel.

In another alternative embodiment, the components of the multiple computer panel and the interactive panel are combined into a single panel which may serve one or more workstations.

DESCRIPTION OF THE INVENTION

Figure 1:
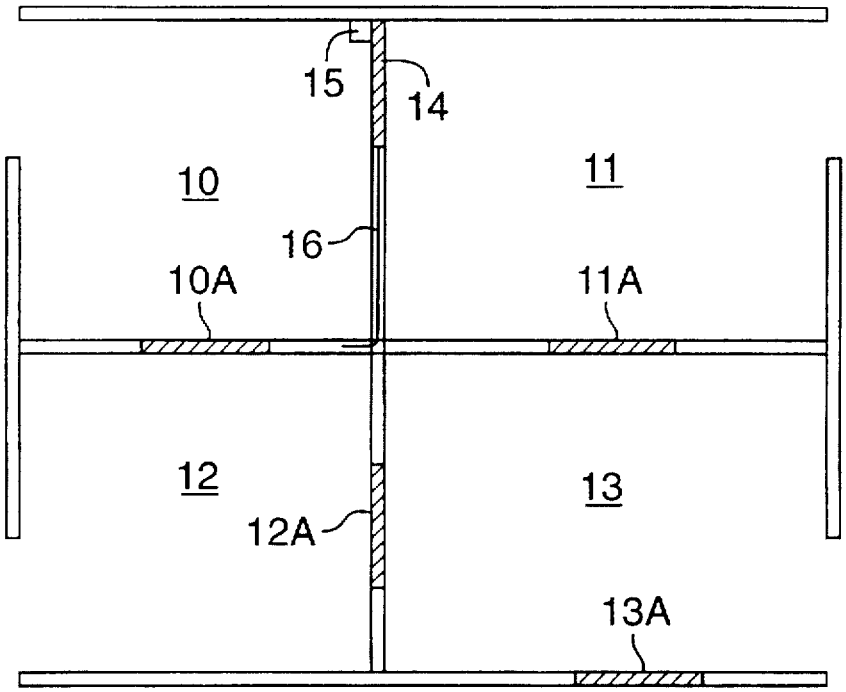
FIG. 1 illustrates a plan view of several workstations showing the locations of the multiple computer panel and interactive panels.

FIG. 1 illustrates a top view of a cluster of workstations, including workstations 10, 11, 12 and 13. The cluster of workstations is served by a multiple computer panel 14, and workstations 10–13 each have interactive panels 10A–13A, respectively, associated with them. Multiple computer panel 14 is connected to each of interactive panels 1OA–13A through lines represented by data line 16 connecting to interactive panel 13A, running through the base units positioned at the bottom of the panels. Multiple computer panel 14 is supplied with electrical power and data via a pole 15 which extends from the ceiling to the floor alongside multiple computer panel 14.

Figure 2:
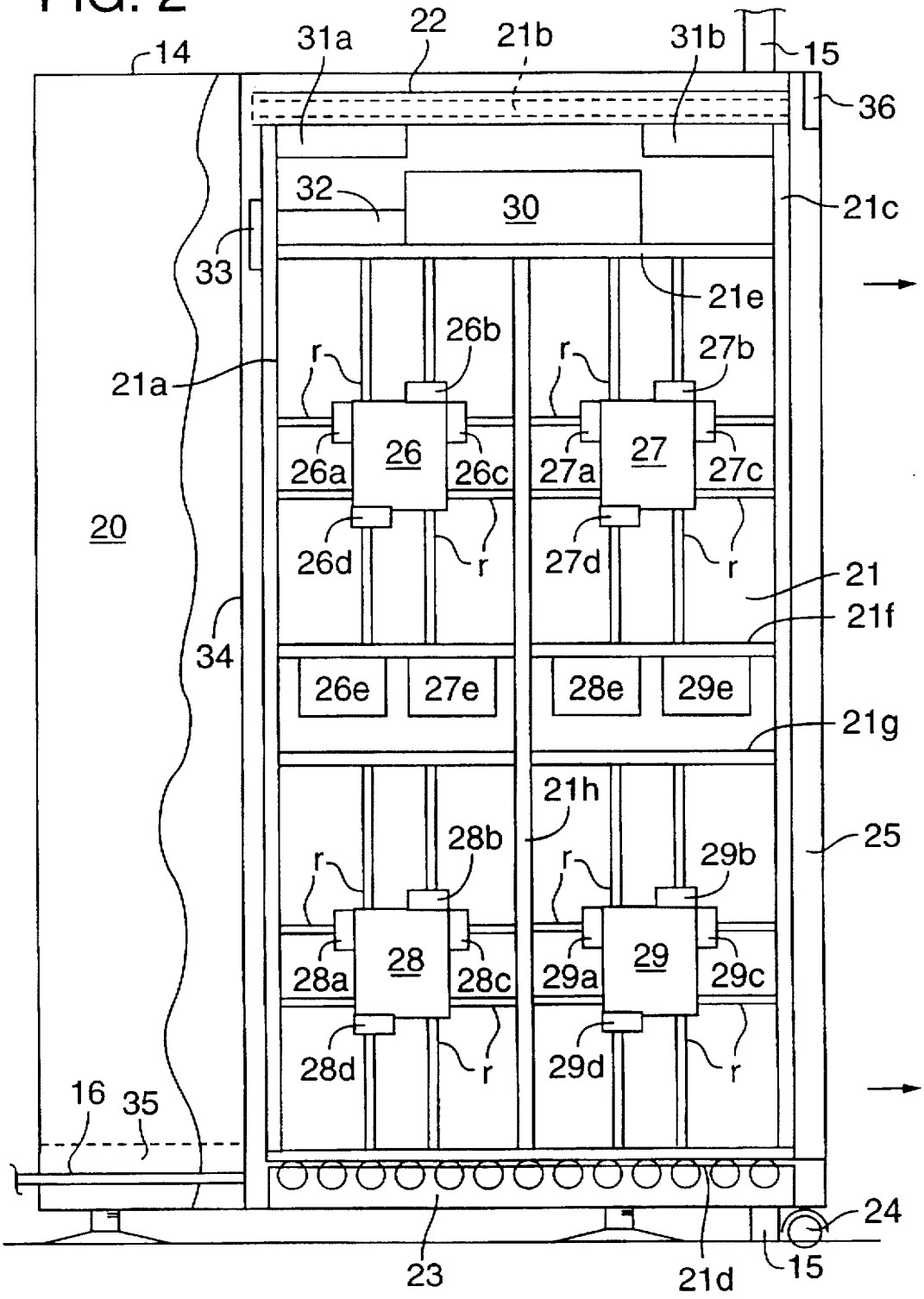
FIG. 2 illustrates a side breakaway view of a multiple computer panel in accordance with the invention.

FIG. 2 illustrates a side breakaway view of multiple computer panel 14, viewed from the right side in FIG. 1. Multiple computer panel 14 includes a stationary housing 20 and an internal movable panel 21. Movable panel 21 is advantageously mounted inside stationary panel 20 in a manner similar to that shown in FIG. 3 of the above-referenced U.S. Pat. No. 5,125,202. (While U.S. Pat. No. 5,125,202 describes a "privacy panel" for an entry to a workstation, in arrangements according to this invention the movable panel may be placed at a variety of locations in the workstation.) The top of movable panel 21 is guided in a channel 22 at the top and rests on a roller rail 23 at the bottom. A roller 24 supports a leading edge 25 of movable panel 21 as it is withdrawn from housing 20. The frame of movable panel 21 includes four outer members 21*a*, 21*b*, 21*c*and 21*d* and four interior members 21*e*, 21*f*, 21*g* and 21*h*. Members 21*a*–21*h* may be constructed of three-eighths inch square metal tubular pieces and may be welded together. Member 21*b* rides inside channel 22, and member 21*d* rests on roller rail 23. Spanning the distances between members 21*a*–21*h* are metal bars designated r, which are preferably flat rolled steel.

Attached to the metal bars r are f our computers 26, 27, 28 and 29. Computers 26–29 each i nclude a plurality of integrated circuit chips, including a microprocessor, a memory chip, etc., attached to a printed circuit board. Each of computers 26–29 has a number of "cards" plugged into it. For example, computer 26 has a video card 26*a*, a fax-modem card 26*b*, an extra memory card 26*c* and a network adaptor card 26*d* attached to it. Cards 27*a*–27*d*, 28*a*–28*d* and 29*a*–29*d* are attached to computers 27–29 and perform functions comparable to cards 26*a*–26*d*, respectively. Suspended from interior member 21*f* are hard disk drives 26*e*–29*e*, which are connected to computers 26–29, respectively. A power supply 30 (preferably including an uninterruptable power supply) is mounted on member 21*e*.

Electric power and data lines extend through power pole 15 an d flexible connectors (not shown) to power supply 30, so as to allow movable panel 21 to be withdrawn from housing 20. Power supply 30 is also connected to computers 26–29 and hard disk drives 26*e*–29*e* by means of connectors which are not shown. To provide adequate cooling for the components in movable panel 21, louvers or vents (not shown) are provided at the top and the bottom of stationary housing 20 and in channel 22. Fan units 31*a*and 31*b*, which for example may include muffin fans, are mounted at the top of movable panel 21 so as to increase the air flow around the components in movable panel 21.

A conduit 32 runs from power supply unit 30 to a plug (not shown) which fits into a socket 33 when movable panel 21 is fully retracted into housing 20. Socket 33 is mounted on a vertical conduit 34 in housing 20. Vertical conduit 34 extends down to a base unit 35 in housing 20. Conduit 34 and base unit 35 contain electrical power and data lines (e.g., data line 16) which are connected to interactive panels 10A–13A (FIG. 1). Thus when movable panel 21 is withdrawn from housing 20, the power and data connections to interactive panels 10A–13A are severed. A key operated locking mechanism 36 fastens movable panel 21 to housing 20 so as to prevent movable panel 21 from being withdrawn.

Figure 3:
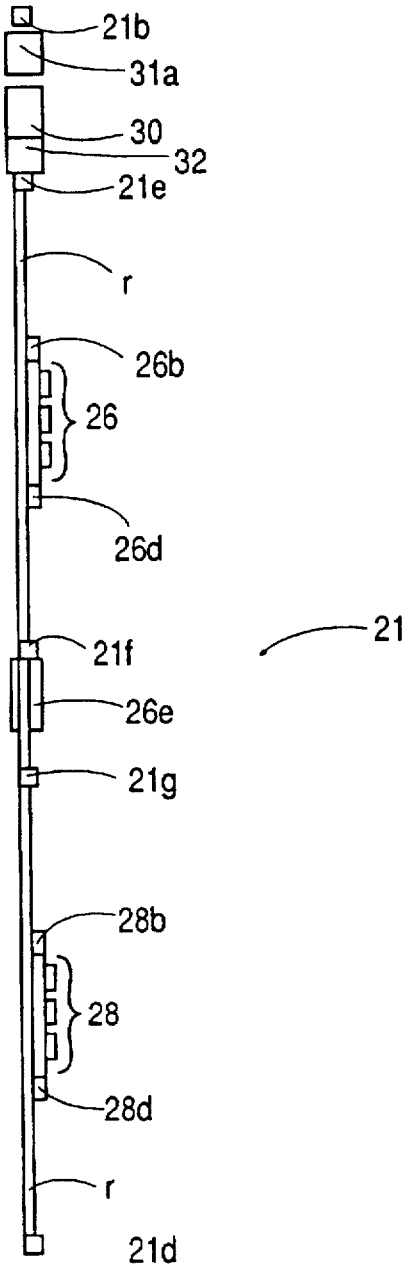
FIG. 3 illustrates a cross-sectional view of the multiple computer panel.

A cross-sectional view of movable panel 21 from the left in FIG. 2 is illustrated in FIG. 3, which shows computers 26 and 28 mounted on one of the vertical metal bars.

Numerous alternatives to the embodiment illustrated in FIGS. 2 and 3 will be apparent. Computers 26–29 may be mounted in a variety of ways, and a variety of cards may be added to or substituted for cards 26*a*–26*d*, 27*a*–27*d*, 28*a*–28*d* and 29*a*–29*d*. Other recording means may be substituted for or added to hard disk drives 26*e*–29*e*. More or fewer computers may be included in movable panel 21. In addition, the computers may be mounted inside a stationary panel, and access to them may be obtained by means other than a movable interior panel, such as by removing or lifting the side walls of the panel. It may be desirable to enclose some of the components in plexiglass or other covers. Other means of providing power and data paths to and from movable panel 21 and between movable panel 21 and interactive panels 10A–13A may be substituted for power pole 15, conduit 32 and socket 33. For example, alternative hard wire techniques as well as infrared, microwave and optical fiber methods may be used.

The pieces of equipment shown in FIG. 2 may be mounted at various positions in the panel. For example, the power supply may be located in the housing 20 to the left of movable panel 21.

Figure 4:
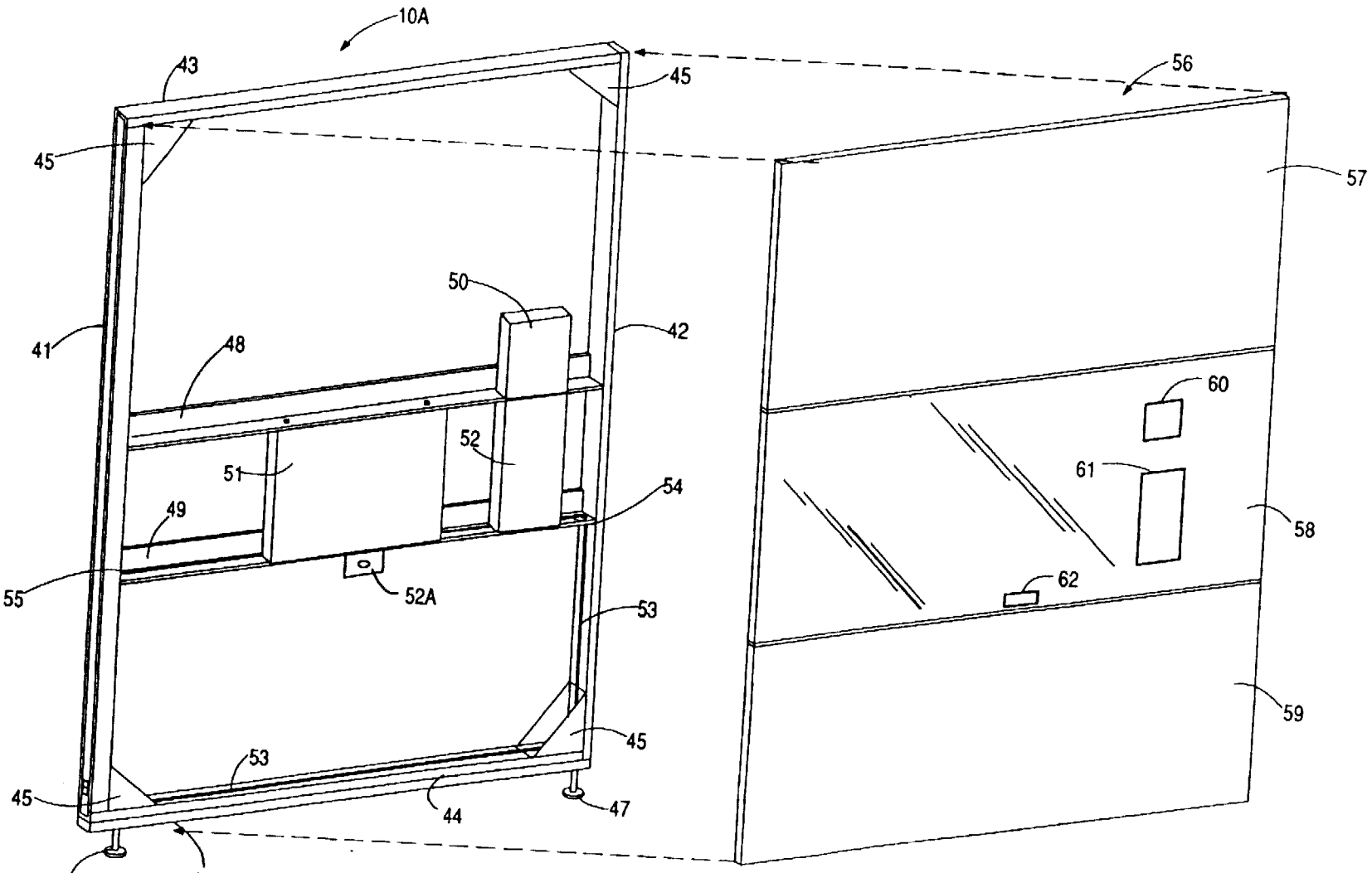
FIG. 4 illustrates an exploded view of an interactive panel in accordance with the invention.

FIG. 4 illustrates an exploded view of interactive panel 10A. The structural elements of interactive panel 10A are those common to most partition panels, namely side beams 41 and 42, a top beam 43, and a bottom beam 44. Beams 41–44 are typically U-beams which are welded together at the corners. Gussets 45 are welded at the corners to provide the frame with structural rigidity. A wooden slat 46 is attached to the bottom of bottom beam 44, and legs 47 are inserted into holes drilled in slat 46.

Horizontal cross beams 48 and 49 span the width of panel 10A between side beams 41 and 42. Cross beams 48 and 49 are L-shaped beams and are welded to side beams 41 and 42.

Various pieces of user interactive equipment are placed on top of or suspended from cross beams 48 and 49. In this embodiment, a telephone speaker 50 is attached to the top of cross beam 48. A computer display 51, preferably using flat screen technology, is positioned in the center of panel 10A between cross beams 48 and 49. A telephone body 52 is positioned between cross beams 18 and 19 directly beneath telephone speaker 5. The telephone handset may be hung from the exterior of the panel. A keyboard/input socket 52A is attached to cross beam 49.

Each of units 50–52 is enclosed in a housing which is preferably made of plastic. Units 50–52 may be attached to cross beams 48 and 49 in a variety of ways which will be apparent. In the embodiment shown, units 50–52 are attached by means of screws which fit into holes which are formed at appropriate places in cross beams 48 and 49. In FIG. 4, the screws attaching the top of display 51 to cross beam 48 are illustrated.

The housings for units 50–52 are approximately one and a half inches in thickness so that they fit easily within the width of L-shaped cross beams 48 and 49.

Power is supplied to units 50–52 through a conduit 53 which is attached to bottom beam 44 and side beam 42 and runs through a hole 54 in cross beam 49. A second electrical conduit 55 runs up side beam 41 and contains data/communication lines which are connected as appropriate to units 50–52.

A front facing unit 56 is attached at the front of panel 10A. Front facing unit 56 consists of an upper fabric section 57, a middle plexiglass section 58 and a lower fabric section 59. The middle plexiglass section 58 of front facing unit 56 is positioned and sized such that when front facing unit 56 is attached to panel 10A, units 50–52 are visible through middle plexiglass section 58. An aperture 60 for telephone speaker 50 and an aperture 61 for telephone 52 are provided in front facing unit 56. An aperture 62 is provided to allow the user to connect a keyboard, computer mouse or other control device to keyboard/input socket 52A. When panel 10A is assembled, a work surface may be cantilevered from the front of panel 10A.

Conduits 53 and 55 connect to multiple computer panel 14, and provide the components in interactive panel 10A the power and data necessary to operate. Conduit 55, in particular, connects keyboard/input socket 52A to one of computers 26–29.

It is apparent that units 50–52 occupy only a relatively small portion of the volume within panel 10A. Accordingly, a duplicate set of units 50–52 may be provided within panel 10A to serve a worker in the workstation 12 on the other side of panel 10A.

Figure 5:
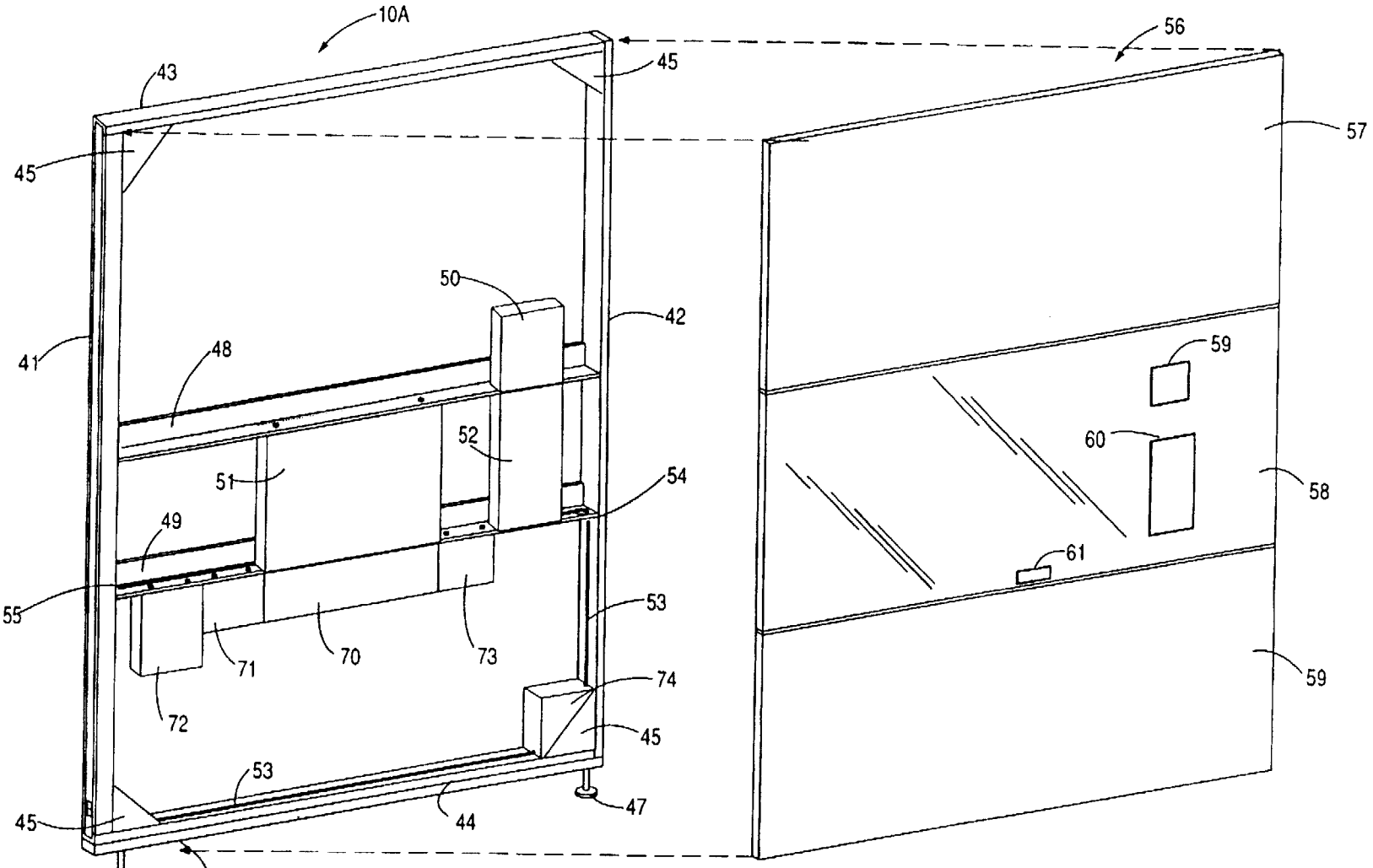
FIG. 5 illustrates an exploded view of a combined computer/interactive panel.

The computer and interactive panels may be combined into a single panel, as shown in FIG. 5. Combined computer/interactive panel 70 is similar to panel 10A (FIG. 4) except that, located directly below display 51, suspended from cross beam 49, is a computer 70. To the left of computer 22 are a facsimile machine 71 and a disk drive 72, both of which are also suspended from cross beam 49. Likewise, a modem 73 is suspended from cross beam 49 to the right of computer 70. Panel 70 also contains a power supply 74.

The partition panel of this invention has numerous advantages. Since the computer circuit boards and other components may be locked inside a panel, the possibility of theft or tampering is reduced. Access to floppy disks, in particular, can be limited, thereby helping to prevent the introduction of computer viruses. Moreover, to the extent that the components are "naked" circuit boards, they are of questionable use outside the panel.

Safety is also enhanced. Placing all wires within a panel wall helps to prevent tripping and reduces the chance of accidental fires or shocks. Seismic safety is improved because components and wires inside a partition system are less likely to break or fall, causing injury.

The costs of running an office are reduced. Rental costs can be reduced on a per employee basis because space is no longer required to house components in individual cases. As a result, workstations can be smaller, and fewer panels are needed to form the individual workstations. The cost of multiple cases for the individual components will be saved. Sharing of computers and other capital equipment among employees is encouraged, and this can have a substantial effect on costs. The cost of cabling is reduced because it is no longer necessary to run power and data lines to each workstation from a central location (e.g., in the ceiling). The cost of electricity should generally be lower because a single power source may supply multiple components.

The costs of relocation are reduced because all components and cabling can easily be transported from one location to another. Fewer materials need to be left behind or become unusable after a relocation. This applies to both moves to new offices and moves within the same office.

The placement of the components in an essentially planar configuration within the partitions makes them easy to access for maintenance and repairs. Moreover, since additional space will normally be available within the partitions, upgrades are facilitated. Also, the equipment can be easily installed because all that is required is to attach a panel to a contiguous panel and connect the power and data cables as necessary. Backing up data is more convenient because all data from a cluster of workstations may be saved with a backup device in a single multiple computer panel. There is no need to devise a complicated backup procedure for numerous hard disk drives in separate computers.

By providing separate "interactive panels" for different employees, the panels can be customized to provide for the needs and skills of each employee. The components in each interactive panel may be ergonomically placed for individual employees.

The availability of straight runs through the panels in workstation clusters raises the possibility of using optical fibers for data transmission. Infrared or microwave techniques may also be used for data transmission. In general, cable runs will be shorter, thus allowing the use of more expensive technologies without paying the cost of running "miles" of cabling for individual workstations through the ceilings, etc.

The integration of numerous components into a large system helps move toward the "paperless" office of tomorrow. There is no need to re-enter data to numerous computers, facsimile machines, etc. This should result in productivity increases.

The potential integration of the telephone system with powerful computer systems may offer numerous advanced features, e.g., programmed phone number blocking monitored by the computer, and instantaneous tally of telephone calls for making comparisons with telephone bills.

File servers and other equipment are sometimes placed in "closets" where environmental conditions (e.g. heat and dirt) may lead to malfunctions. Placing these components in the same office environment used by humans will overcome many of these problems. Also, file servers and the like may be located near the offices or workstations of particular workers, e.g., office managers or administrators.

From a manufacturing standpoint, making computer technology planar instead of cubic simplifies the manufacturing, quality control, and servicing of the components. Planar technology lends itself, in particular, to robotic construction. A single power source and a single cooling system may be used for all components within a given panel. The large surface area of the panel permits the separation of heat generating from heat sensitive components. Storage and shipping costs may be reduced by eliminating a multitude of separate containers. Eliminating the separate plastic "boxes" used to house separate pieces of equipment also satisfies environmental concerns.

The broad principles of this invention are applicable to the mounting of any piece of data processing or communications equipment within a partition panel, including but not limited to computers and their components such as microprocessors and memories, displays, telephones, modems, facsimile machines, speakers, microphones, disk drives for hard or floppy disks and employing magnetic, magneto-optic or other technologies, workstations, "punchdown" boards for telephones and other communications systems, minicomputers, file servers, networking hubs and backup devices. Further, the principles of this invention apply whether the data processing or communications equipment is mounted as integral units or broken down into components (e.g., a microprocessor connected to separate RAMs), whether the equipment is mounted "bare" or enclosed in a cover, or whether access to the equipment is obtained by means of a movable interior panel, through the side walls of a stationary panel, or otherwise. The principles of this invention apply to partition panels located in homes, offices, factories, stores, warehouses, or any other location where data processing or communications equipment is used.

Moreover, while the embodiment described above includes a "multiple computer panel" in combination with "interactive panels", it will be apparent to those skilled in the art that individual partition panels according to this invention can be combined with one another in a wide variety of ways, in single or multiple-tiered arrangements, with individual pieces of equipment operating alone or in cooperation with one or more other pieces of equipment.

The foregoing embodiments are intended to be illustrative only. Numerous other embodiments will be apparent to those skilled in the art, all of which are included within the broad principles of this invention, as defined in the following claims.

We claim:

1. A partition panel, said partition panel having a thickness no greater than that of partition panels of the kind generally used in open plan offices, said partition panel comprising an internal cavity, an internal movable panel being positioned in said internal cavity and having mounted thereon within said internal cavity at least one piece of data processing or communications equipment, an aperture being located at a peripheral edge of said partition panel, said aperture providing an opening to said cavity such that said internal movable panel can be withdrawn from said partition panel through said aperture.

2. The partition panel of claim 1 wherein said at least one piece of equipment comprises a computer and a display.

3. The partition panel of claim 1 wherein said at least one piece of equipment comprises a telephone.

4. The partition panel of claim 1 wherein said at least one piece of equipment comprises a modem.

5. The partition panel of claim 1 wherein said at least one piece of equipment comprises a facsimile machine.

6. The partition panel of claim 1 wherein said at least one piece of equipment comprises a speaker.

7. The partition panel of claim 1 further comprising a rail for guiding said internal movable panel.

8. The partition panel of claim 1 wherein said panel comprises a pair of parallel exterior walls, said exterior walls having outside surfaces separated by no more than approximately two inches.

9. The partition panel of claim 1 wherein said partition panel is approximately five feet high and approximately four feet wide.

10. The partition panel of claim 8 wherein said partition panel further comprises a means for locking said internal moveable panel inside said partition panel.

11. The partition panel of claim 1 comprising a removable wall for accessing said internal cavity of said partition panel.

12. The partition panel of claim 1 wherein said partition panel comprises:

two substantially vertical side beams, each side beam having a top end and a bottom end;

a substantially horizontal top beam, said top beam having one end connected to the top end of one of said side beams and the other end connected to the top end of the other of said side beams;

a substantially horizontal bottom beam, said bottom beam having one end connected to the bottom end of one of said side beams and the other end connected to the bottom end of the other of said side beams; and a cross beam having one end connected to one of said side beams and the other end connected to the other of said side beams, wherein said piece of data processing or communications equipment is mounted on said cross beam.

13. The partition panel of claim 12 further comprising a front facing unit, said front facing unit having apertures for connection of control devices to said piece of data processing or communications equipment.

14. The partition panel of claim 13 wherein said front facing unit comprises a plexiglass section.

15. The partition panel of claim 1, said partition panel further comprising a wireless receiver for receiving data and/or power for use by said at least one piece of data processing or communications equipment.

16. The partition panel of claim 15 wherein said wireless receiver comprises a microwave receiver.

17. The partition panel of claim 15 wherein said wireless receiver comprises an infrared receiver.

18. The partition panel of claim 1, said partition panel further comprising a wireless transmitter for transmitting data from said at least one piece of data processing or communications equipment.

19. The partition panel of claim 18 wherein said wireless transmitter comprises a microwave transmitter.

20. The partition panel of claim 18 wherein said wireless transmitter comprises an infrared transmitter.

* * * * *